United States Patent [19]

Long

[11] 4,142,497

[45] Mar. 6, 1979

[54] FUEL PRESSURE BOOSTER AND REGULATOR

[75] Inventor: E. David Long, Elmira, N.Y.

[73] Assignee: Allied Chemical Corporation, Morris Township, Morris County, N.J.

[21] Appl. No.: 629,351

[22] Filed: Nov. 6, 1975

[51] Int. Cl.[2] ..... F02M 59/16

[52] U.S. Cl. ..... 123/139 AN; 123/139 AW

[58] Field of Search ..... 123/137, 139 AS, 139 AN, 123/139 AV, 139 AW; 417/244, 254, 265, 471, 542; 92/129

[56] References Cited

U.S. PATENT DOCUMENTS

| | | | |
|---|---|---|---|
| 1,801,447 | 4/1931 | Muzzy | 417/471 X |
| 1,904,799 | 4/1933 | Palmer | 417/471 |
| 1,965,666 | 7/1934 | Muzzy | 417/471 X |
| 2,980,031 | 4/1961 | Russell | 417/452 |
| 3,192,864 | 7/1965 | Notte | 417/542 |
| 3,205,829 | 9/1965 | Andersen et al. | 417/542 |
| 3,465,732 | 9/1969 | Kattchee | 123/139 AW X |
| 3,507,263 | 4/1970 | Long | 123/139 R |
| 3,581,723 | 6/1971 | Scholl | 123/140 MP |
| 3,909,159 | 9/1975 | Jansen et al. | 417/471 X |

*Primary Examiner*—Ronald H. Lazarus
*Assistant Examiner*—Tony M. Argenbright
*Attorney, Agent, or Firm*—Ernest D. Buff; John P. Kirby, Jr.

[57] ABSTRACT

A fuel injection system for an internal combustion engine employs a relatively low pressure pump to provide fuel to injectors located at the engine cylinders. A booster device for maintaining the fluid pressure constant, at a substantially higher level, is connected in series with the line between the pump and the injector and includes one way valves at its inlet and outlet. The booster employs a chamber connected to the fuel line and pressurized by a piston which acts to contract the chamber volume under the force of the coil spring. The piston is cocked against the spring at regular intervals to renew the original volume of the chamber by an arm driven from the engine crankshaft. Sealed volume converters having flexible diaphragm walls are disposed adjacent to the inlet and outlet of the booster device and in the fluid conduit adjacent the injectors to obviate sharp drops in the fluid pressure in the fuel line when the injectors actuate.

20 Claims, 5 Drawing Figures

FUEL PRESSURE BOOSTER AND REGULATOR

BACKGROUND OF THE INVENTION

This invention relates to fuel metering and injection systems for internal combustion engines incorporating means for providing the injectors with a supply of fuel at a high, regulated pressure. The invention may be used in a fuel injection system, such as that described in my U.S. patent application Ser. No. 629,421, entitled "Fuel Injection System," filed concurrently herewith on Nov. 6, 1975. The invention is related to my U.S. Pat. No. 3,507,263 issued Apr. 21, 1970.

In fluid metering and injection systems employing electrically actuated injectors, the precision of control of the injection volume is proportional to both the magnitude of the fluid pressure in the conduit feeding the injectors. The degree of regulation of the pressure to a high, regulated pressure is desirable. With relatively large engines, the injection systems may also be called up to produce high flow rates of fuel. Previous systems typically employed electric pumps powered by the vehicle electric system to provide this large fuel volume at pressure to the injectors. These pumps may produce a flow in excess of the maximum fuel demands of the engine and the excess fuel was fed back to the fuel tank through a pressure overflow valve and a return conduit. At low throttle levels a large portion of the pumped fuel was returned and, as a result, the gasoline might be circulated through the pump a large number of times before finally being admitted to a combustion cylinder. The resulting churning and agitation of the gas is generally considered deleterious to its combustion characteristics.

High pressure, high volume fluid pumps have been generally unavailable. Attempts to achieve such a design have produced pumps which are expensive, unreliable, large and noisy. In the prior art, the conflict between cost and performance was typically simplified by lowering the pressure of the system to a compromise level of pressure. Previous fuel injection systems typically employed fuel pressures of about 25–40 psig. in the fuel lines to the injectors while pressures in excess of twice these values would be desirable for increasing the precision of the injection process.

Previous fuel injection systems have required regulation of the pressure of the fuel provided to the injectors. Since the fuel flow through the injector is a function of the fuel line pressure, variations in that pressure result in variations in volume of fuel injected into a cylinder. The primary purpose of the fuel injection system is to improve the control of the volume of fuel fed to each cylinder over the relatively rough control obtained with conventional carburetion systems. Large variations in the fuel pressure to the injectors defeat the central purpose of the fuel injection system. In previous systems, the pressure regulation was adversely affected by line pressure drops which occurred each time an injector was actuated and instantaneously reduced the fuel pressure at the injector. This produced a low pressure, or expansion wave, which traveled through the system, reducing the localized fuel pressure at its locus. These pressure waves would be reflected from the end walls of the system. The rapid actuation of the injectors would induce a number of these waves, resulting in variations in the fuel pressure throughout the lines feeding the injectors.

The present invention is broadly directed toward a fuel injection system capable of providing substantially higher fuel pressures in the fuel lines to the injectors than systems of the prior art and of attaining a much higher degree of regulation of that pressure so that the quantity of fuel fed to a cylinder intake valve upon actuation of the injector is substantially a function of the time duration during which the injector is actuated.

SUMMARY OF THE INVENTION

Like the prior art, the present invention utilizes a pump to feed fuel from a tank to the injectors. Unlike the prior art, the pressure in the feed lines at the injectors is substantially higher than the output pressure of the pump and is regulated independently of any regulation provided by the pump; that is, the pump outlet pressure may vary over a relatively wide range without adversely affecting the fluid pressure at the injectors. This mode of operation is broadly attained by the provision of a one-way valve in the feed line between the pump and the injectors and the pressurization of the fluid line between the one-way valve and the injectors with a variable volume chamber connected to the feed line. The chamber has at least one wall section that may be moved to vary its volume. A relatively constant force is exerted on this chamber wall to urge it toward motion in a direction which would contract the chamber volume. This pressurizes the fuel in the flow section between the one-way valve and the injectors to a level which is a function of the area of the movable chamber wall and the force imposed on that wall and which is substantially higher than the pump pressure.

When one or more injectors are actuated, reducing the fluid volume contained in the system downstream of the one-way valve the momentary reduction in pressure in the variable volume chamber causes an unbalanced force to be imposed on the movable chamber wall and the wall moves to reduce the volume of the chamber by substantially the amount of fuel ejected into the engine, and to restore the original high pressure in the downstream end of the system. The chamber volume is thus gradually reduced and means are provided, preferably powered by the engine, for periodically moving the chamber wall in a reverse direction, against its biasing means, to restore the chamber to a maximum volume. During the period that this restoring force is imposed upon the chamber wall, the chamber pressure drops substantially. In order to isolate the injectors from this pressure drop, a second one-way valve is disposed between the chamber and the injectors so that the pressure at the injectors is maintained substantially constant. During enlargement of the volume, the cylinder pressure in the pressure booster drops below the pump pressure, allowing the fluid in the chamber to be replenished through the one-way valve disposed between the pump and the chamber. After the restoring force is removed from the chamber wall, the biasing force moves the wall to contract the chamber, raising its pressure to the higher level and opening the one-way valve that connects the chamber to the injectors.

The sudden pressure reduction in the chamber when it undergoes enlargement causes an expansion wave to propogate in the direction of the pump and the pressure of this wave may be so low as to cause fuel to vaporize. To prevent this and assure the chamber of an adequate fuel supply from the pump end during the replenishment stroke, a sealed, pressurized volume having a flexible diaphragm wall is disposed between the variable volume chamber and the one-way valve leading to the pump. When the variable volume chamber is at its high pressure, the diaphragm flexes inwardly, compressing the sealed volume. When the chamber pressure drops during the replenishment stroke, the diaphragm moves outwardly from the sealed volume to effectively pump fuel into the chamber and thus maintain the chamber pressure sufficiently high to prevent vaporization of the fuel. A similar diaphragm sealed volume is disposed immediately downstream of the one-way valve connected between the chamber outlet and the injectors and acts as a low volume, high pressure fluid source to maintain the pressure at the injectors during the brief period of the replenishment stroke of the chamber.

In the preferred embodiment of the invention the variable volume chamber takes the form of a cylinder having a piston movable therein. The piston is urged towards motion in a direction to reduce the fluid containing volume of the cylinder, and thus pressurize the fuel, by an elongated coil spring which bears against the piston's outside wall. The length of the spring is large in comparison to the piston movement between the minimum and maximum chamber volumes so that the force imposed on the piston by the spring in these two positions, and thus the pressure induced into the fuel, varies by only a small degree.

An important aspect of the invention is the frequent replenishment of the cylinder volume, preferably in timed relation to the operation of the engine, so that the replenishment stroke will be quick and short and will not interfere with the continuous operation of the system. In the preferred embodiment the piston is regularly recocked, compressing the spring, by an arm driven by the engine cam-shaft. The arm thus restores the piston to its original position, and recocks the spring, once each engine cycle. The cylinder volume which must be replenished during that stroke is thus substantially equal to the volume of the fuel injected into the engine during one stroke. The short, quick replenishment stroke maintains the spring force on the piston relatively constant and minimizes the magnitude of the pressure waves induced in the injection conduit during replenishment.

In the preferred embodiment of the invention, the elements of the pressure booster and regulator system, including the piston, chamber, spring, one-way valves, diaphragm enclosed volumes and recocking mechanism, are formed in a unitary device which is mounted on the engine so as to be in contact with the cam-shaft, and is connected to the other elements of the system by a single inlet and a single outlet. This arrangement provides important economic and service advantages over the alternative of forming the elements of the system individually.

The system of the present invention thus provides a high pressure, highly regulated fluid supply to the injector in an economical manner without the use of an expensive high pressure high volume pump with its attendant disadvantages.

Other objectives, advantages and applications of the present invention will be made apparent by the following detailed description of a preferred embodiment of the invention. The description makes reference to the accompanying drawings in which.

Figure 1:
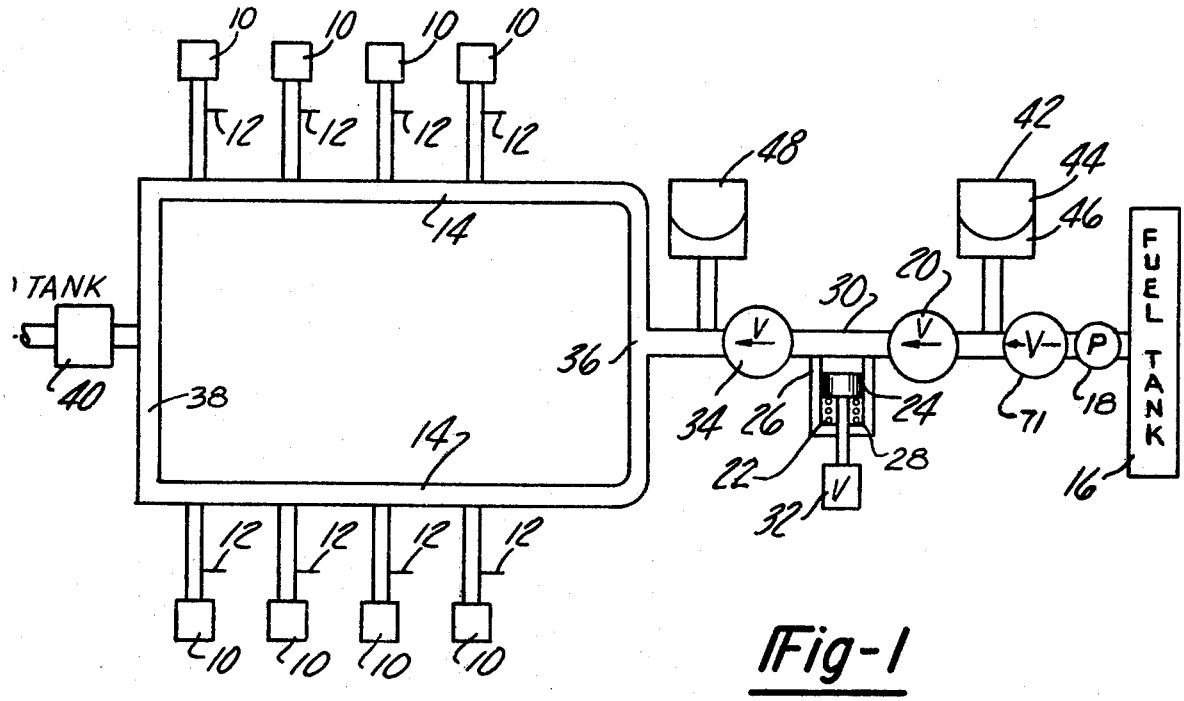
FIG. 1 is a schematic diagram of a system for feeding fuel to a plurality of injector valves formed in accordance with my invention.

Referring to the drawings, FIG. 1 schematically illustrates a system for providing fuel under a high, relatively constant pressure to eight fuel metering injectors 10 arranged to provide controlled bursts of fuel to the intake valve areas of an eight cylinder internal combustion engine. The injectors 10 may be of any well-known type, such as those disclosed in my U.S. Pat. No. 3,412,718. Electric signals applied to the injector 10 through wires 12 open the injection valves for controlled periods of time based on measured engine operating conditions, such as manifold pressure, engine temperature, atmospheric pressure and the like. The quantity of fuel ejected from the injectors during this signal period is a function of the pressure at the injectors.

Fuel is provided to the injectors 10 by a pair of conduits 14 termed fuel rails. Fuel for feeding the rails is derived from a fuel tank 16 through a low pressure conduit 17, booster conduit 30 which forms part of the pressure booster and regulator, and high pressure conduit 36. A low pressure supply, pump 18 operates to feed fuel from the tank through a one-way valve 20. The pump 18 may be electrically powered or driven by the engine in the manner of a conventional automotive fuel pump. It should be capable of pumping fuel at a volumetric rate in excess of the engine requirements at the maximum throttle opening. For a relatively large 8-cylinder engine this may be in excess of 50 gallons per hour. The outlet pressure of the pump 18 may be substantially lower than the 25–50 pounds per square inch provided by fuel pumps for typical injection fuel systems of the prior art. In a preferred embodiment of the system a 5–10 pound per square inch outlet pressure will suffice. This pressure need not be well regulated and may vary with engine speed. Accordingly, the pump 18 should be substantially simpler and lower in cost than fuel pumps used with previous injection systems.

A fuel pressure booster and regulator generally indicated at 22 receives fuel passed through the one-way valve 27 from pump 18. The booster and regulator is schematically illustrated as comprising a piston 24 movable within a cylinder 26 and biased by a spring 28. The spring biases the piston in a direction as to move the piston 24 to contract the volume of the cylinder 26 in communication with the booster line 30. This increases the fuel pressure in the booster line 30, the high pressure conduit 36 and the rails 14 to an elevated pressure. The one-way valve 20 prevents this increase in pressure from forcing a reverse flow to the pump 18.

A reset mechanism 32 is schematically illustrated as being connected to the piston 24 to periodically move the piston against the bias of the spring 28 to enlarge the volume of the cylinder 26 in communication with the booster line 30. This lowers the pressure in the booster line 30 and allows momentary flow from the pump 18 through the one-way valve 20.

A second one-way valve 34 is connected downstream of the booster and regulator 22. When the piston 24 moves under the bias of the spring 28 to contract the volume of the cylinder 26, the second one-way valve 34 allows the resulting high or elevated pressure to communicate with the high pressure fuel line 36 that connects to the fuel rails 14, thus imposing this higher pressure on the rails. When the reset mechanism 32 withdraws the piston against the force of the spring 28, allowing the pump 18 to force fuel into the low-pressure fuel line 17, the one-way valve 34 prevents backflow in the high pressure fuel line 36 toward the pressure booster 22 and thus maintains the high pressure in the rails 14.

Optionally, the far ends of the rails may be connected together by a return fuel line 38 to form a closed circuit. A constant bleed one-way valve 40 connects the return fuel line 38 back to the fuel tank 16.

A fluid wave converter 42 is connected to the low pressure fuel line 17 immediately upstream of the valve 20. The converter is essentially of the same type disclosed in my U.S. Pat. No. 3,507,263. Schematically, it comprises an enclosed volume 44 separated from the low pressure fuel line 17 by flexible diaphragm 46. The diaphragm 46 assumes a position wherein the forces on its opposite sides are equal. Thus, when the line pressure increases, the diaphragm moves to contract the volume of the chamber 44 and thus pressurize the sealed volume. Conversely, when the line pressure falls, the diaphragm moves to expand the sealed volume. When the diaphragm 46 moves outwardly in response to a lowering in the fuel pressure in the line it effectively pumps a volume of fuel into the line, tending to raise the line pressure. Conversely, when the diaphragm contracts in response to an increase in line pressure it increases the flow volume connected to the line and thus tends to decrease the pressure. The converter 42 thus acts to stabilize line pressure in the low pressure fuel line 17.

When the piston 24 is retracted against the bias of the spring 28 by the unit 32 so that the pressure in the line 30 falls below the outlet pressure of the pump 18, and the one-way valve 20 opens, the decrease in pressure at the inlet to the converter 42 causes the diaphragm 46 to expand and supply a volume of fuel which replenishes the chamber 26. In the absence of this device the sharp low pressure wave generated by expansion of the cylinder 26 might vaporize the fuel in the line between the pump and the booster.

A similar converter 48 is connected to the fuel line immediately downstream of the one-way valve 34. This converter provides a pressurized fuel source to the high pressure line 36 during the short interval when the piston 24 is resetting. Accordingly, the valve 34 isolates the booster line 30 from the high pressure line 36. The converter 48 also acts to minimize the travel of expansion and compression waves through the high pressure line 36.

Figure 2:
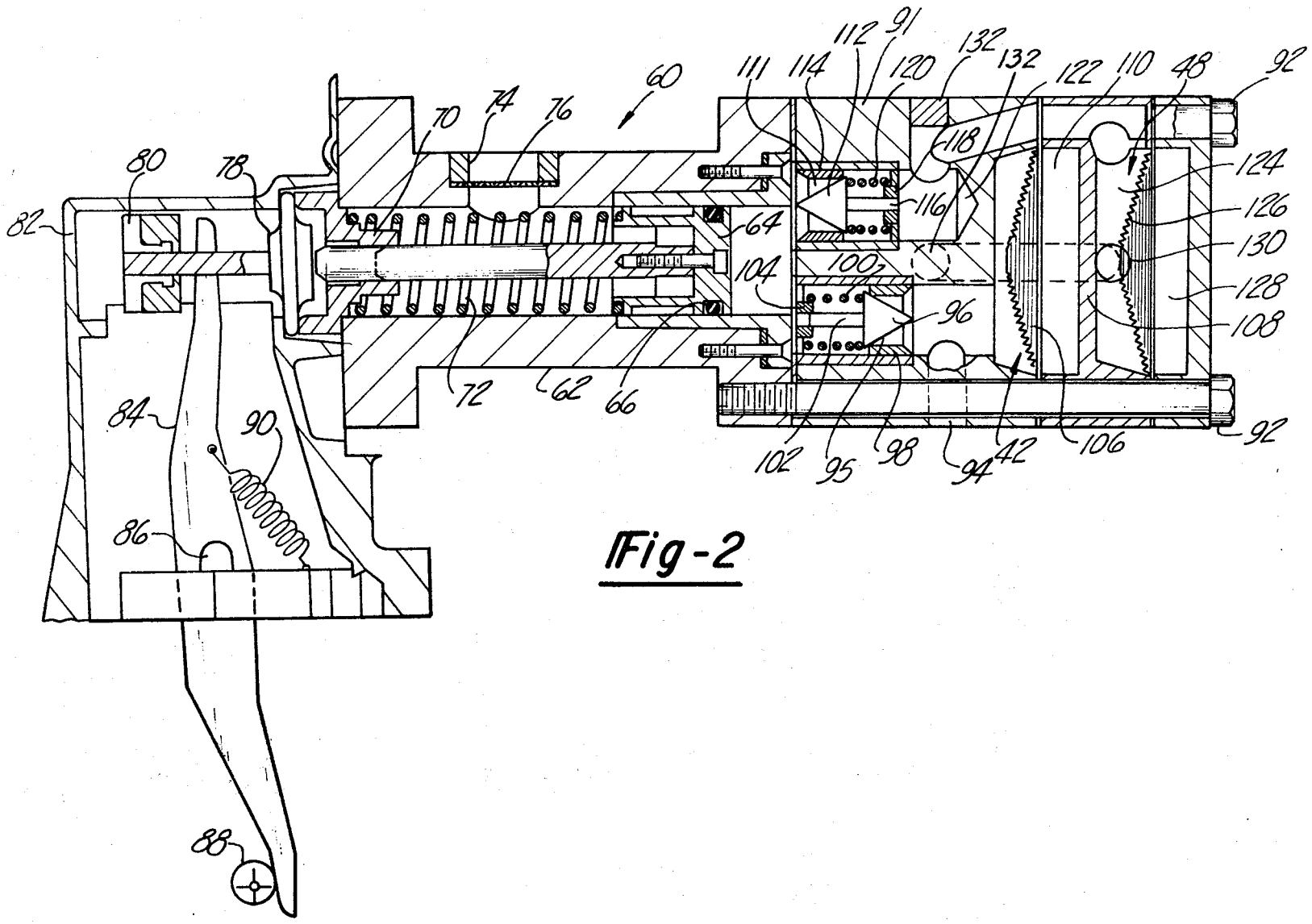
FIG. 2 is a cross-sectional view through a fuel pressure booster and regulator device for use in connection with the system of FIG. 1.

FIG. 2 illustrates a unitary device incorporating the booster and regulator 22, the one-way valves 20 and 34 located upstream and downstream respectively from the booster, and the fluid storage converters 42 and 48. The device, generally indicated at 60, employs a housing 62 having a cylindrical bore. A piston 64 is slidably supported within the housing 62, and an O-ring 66 supported in a groove in the piston skirt seals the piston wall against the internal diameter of the cylinder. A rod 68 is connected to the rear end of the piston and the rod is slidably supported in a guide bushing 70 retained in the opposite end of the cylinder bore. A relatively long first coil spring 72 surrounds the pull rod 68. The ends of coil spring 72 bear against the rear of the piston 64 and the bushing 70. The first coil spring 72 biases the piston rod toward movement to the right, as viewed in FIG. 2.

A cylinder volume of the bore between the rear end of the piston and the opposing end of the bushing is vented to atmosphere and/or to the fuel tank by a hole 74 covered by a screen 76. The extreme end of the pull rod 68, beyond the guide bushing 70, extends through an oil seal 78 and has a cushion member 80 affixed to its extreme left end. The cushion member projects into a housing 82 which is attached to a crankcase of the engine serviced by the injection system. The end of the housing 62 through which the pull rod 68 projects is affixed to or integral with the crankcase housing 82.

An elongated actuator arm 84 is pivotably supported on a fulcrum pin 86 within the housing. One end of the actuator arm projects into the crankcase area and bears against a cam 88 formed on the engine camshaft. A second coil spring 90 connected to the arm 84 on the opposite side of the fulcrum pin and to the housing, urges the end of the actuator arm against the cam 88.

The opposite end of the actuator arm is forked and surrounds the piston rod 68 between the cushion end 80 and oil seal 78. The action of the first coil spring 72 on the piston 64 causes the cushion member to bear against the forked end of the actuator arm in the absence of fuel within a chamber forward of the piston. However, when the chamber is filled with fuel, the piston can only move to the right in FIG. 2 until it imposes a pressure on the fuel sufficient to offset the force of the spring 72.

The actuator arm pivotably reciprocates under the force of the cam 88 as the engine camshaft rotates. At one extreme of the reciprocation the actuator arm pushes cushion member 80 to the position shown in FIG. 2. The upper end of the actuator arm 84 then moves to the right allowing the piston to bear against fuel in the chamber. On the return stroke of the arm, it again resets the piston into position.

A manifold 91 is retained at the piston end of the housing 62 by bolts 92. The manifold contains an inlet port 94 which is connected to the outlet of the pump 18. The port communicates with a first valve passage 95 which is the equivalent of the one-way valve 20 schematically illustrated in FIG. 1. The valve passage 95 has a valve member 96 which cooperates with an annular seat member 98 and is urged against the seat by a relatively light third coil spring 100. A stem 102 connects to the end of the valve and slides in a guide 104 disposed in the opposite end of the valve passage. The valve passage communicates with the cylinder volume forward of the piston 64 to allow flow into the volume but prevent flow out of the volume.

The pressure imposed on the valve member 96 by the third spring 100 is sufficient to retain the valve member against the seat in opposition to gravity forces.

The inlet port 94 also communicates with the volume surrounding an inlet port side of a first pleated flexible diaphragm 106. The first diaphragm cooperates with a wall 108 formed across the manifold, to seal a volume 110. The first diaphragm and the volume are the equivalents of the diaphragm 46 and the sealed volume 44 illustrated schematically as part of the fuel storage converter 42 in FIG. 1. When the pressure in the inlet passage 94 exceeds the pressure in the chamber forward of the piston 64, the valve member overcomes the spring pressure and allows fuel flow from the volume 42 and inlet port into the cylinder chamber.

The chamber forward of the piston 64 discharges through a second valve passage 111 having a second conical valve member 112 which cooperates with an annular seat 114 to form a one-way valve equivalent to the one-way valve 34 of FIG. 1. A valve stem 116 moves in a guide 118 formed at the outlet of the valve passage. A fourth coil spring 120 is compressed between the rear side of the second valve member 112 and the guide 118 and urges the valve member 112 into abutment with the seat. The valve member 112 and valve seat 114 allow flow out of the chamber but prevent flow into the chamber.

Fuel flowing through the valve 112 goes through a passage 122 which leads to a volume 124 on the opposite side of the wall 108 from the volume 110. The volume 124 is bounded by a second pleated flexible diaphragm 126 which cooperates with the end wall of the manifold to form a sealed volume 128. This volume and the second diaphragm are the equivalent of the fluid wave converter 48 illustrated schematically in FIG. 1. Volume 124 discharges out of the manifold 90 through a passage 130, which connects to a discharge port 132. This discharge port connects to the high pressure fuel line 36 shown in FIG. 1.

In operation, the inlet passage 94 of the booster and regulator assembly 60 is connected to the outlet of a relatively low pressure pum 18 (FIG. 1). The outlet port is connected to fuel rails 14 (FIG. 1) through the high pressure line 36 (FIG. 1). Assume that the fuel injection system (FIG. 1) is initially empty of fuel and the engine ignition switch and starter switch are closed. The pump 18 will be energized and will draw fuel from the tank 16 and create a pressurized flow through the first valve 96, the chamber of the cylinder 62, the second valve 112 and the line 36 (FIG. 1), filling up the rails 14 (FIG. 1). During this time, the engine will cause the actuator arm 84 to reciprocate, forcing the piston 64 back against the spring 72. Until the system fills with fuel, the pressure on the face of the piston 64 will not be sufficient to retain the piston in a cocked position. When the system fills, the piston will immediately exert its full force on the relatively incompressible fuel and will raise the pressure in the system, downstream of the valve 96, to substantially above the outlet pressure of the pump 18. For example, this pressure in the fuel line 36 and rails 14 may be in the vicinity of 100 p.s.i.g. This will force the valve member 96 to close, blocking off further flow from the pump 18.

The injector valves 10 may be opened simultaneously, in groups, or in serial sequence. In any event, when each injector is opened, it tends to deplete the volume of the system downstream of valve 96 and will effectively generate a low pressure wave which will move from the open injector toward the pressure booster and regulator 60. When it reaches the chamber 62, the lowered force on the piston 64 will allow the piston to move slightly under the force of the spring 72 until the pressure imbalance is corrected. The motion will be sufficient to diminish the free volume of the chamber by the quantity of fuel ejected through the injector. This action will effectively generate a pressure wave which will move back toward the injector.

During one cycle of the engine all of the injectors will be opened once and the piston 64 will move forward to reduce the free volume of the chamber by substantially the volume of fuel ejected. Once each cycle, the actuator arm will move against the cushion member 80 to recock the piston to its original position. Once the system is filled with fuel, the cushion member will not follow the actuator arm 84 through its full reciprocation, but will remain near the original position of the actuator arm 84.

Each time the piston 64 is withdrawn by motion of the actuator arm 84 the valve member 112 will close and the valve member 96 will open. During the closing of the valve member 112, the diaphragm 126 will move outwardly in response to expansion pressure waves in the fuel to maintain substantially constant pressure to the injectors. Such an expansion pressure wave propogating from the injectors reaches the diaphragm 126 before it reaches the valve 112.

Similarly, when the valve 96 opens in response to a sharp drop in pressure in the chamber occurring upon withdrawal of the piston, the expansion pressure wave hits the diaphragm 106 and causes it to move outwardly to effectively supply the quantity of fuel required to replenish the chamber. After the piston moves to re-establish pressure in the chamber, the valve 96 closes and the pump 18 re-establishes the original position of the diaphragm 106.

When the engine is shut off, the valve members 112 and 40 retain the rails 14 full of fuel. When the engine is shut-off, valve members 96 and 112 will close. Over a period of time, there will necessarily be some leakage through the valves 96 and 112 from the system and the pressurization will not be maintained indefinitely, but sufficient residual fuel in the system will allow rapid repressurization and a quick startup of the engine. Preferably, a positive check valve 71 is positioned in the line close to the downstream side of the pump 18 to prevent leak back indefinitely.

Figure 3:
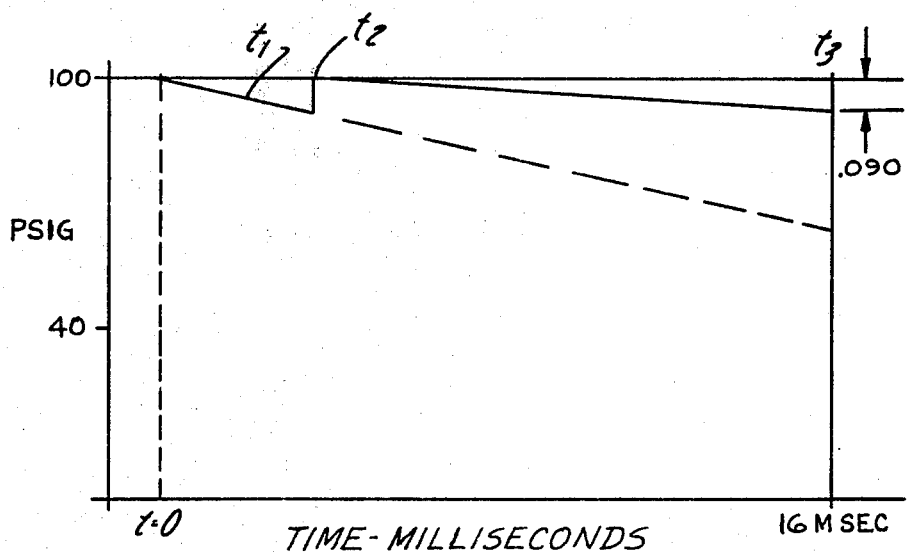
FIG. 3 is a plot of fluid pressure at an injector during an injection cycle, illustrating the operation of the present invention.

FIG. 3 graphs the pressure at an injector 10 during a maximum width injector pulse. At time T = zero, the beginning of the pulse, the pressure in the rail 14 is at maximum level, which may be, for example, 100 pounds per square inch gage. As the injector opens removing fuel from the system, the pressure at the injector begins to gradually decrease. At the same time, an expansion pressure wave is propogated down the rail in the direction of the pressure booster and regulator. This pressure wave may reach the pressure booster and regulator at time T1. The booster then responds by providing a compression wave to the system which reaches the injector 10 at time T2, raising the pressure back to 100 p.s.i.g. During the balance of the stroke, the pressure in the rail is equal to the pressure imposed on the fluid by the piston 64, but this pressure gradually decreases as the piston moves, lengthening the first spring 72, since the force imposed by the first spring is proportional to its elongation. At T3, the end of the injector pulse, the pressure will have dropped to some value that is dependent upon the configuration of the booster. The average pressure provided to the injector during the cycle is between the minimum and maximum pressures occurring during this cycle.

Figure 4:
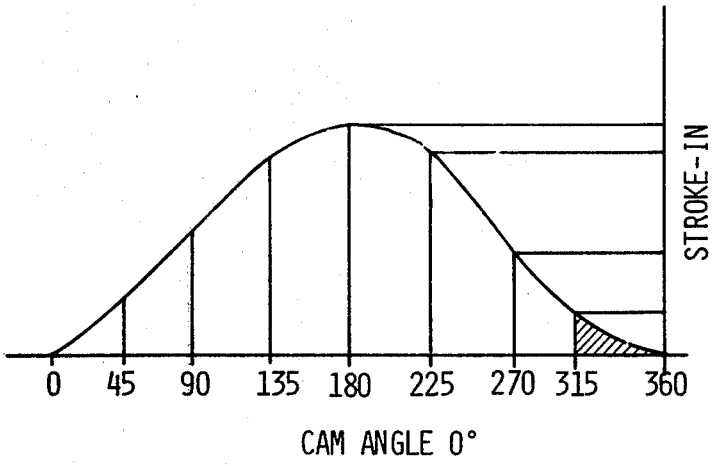
FIG. 4 is a plot of piston stroke and displacement volume as a function of the angle of a cam which drives the booster and regulator, illustrating the operation of the present invention.

The decrease in pressure as a result of the piston motion is a function of the length of the spring, the area of the piston and the volume of fuel injected during one cycle. FIG. 4 is a plot of the angle of the cam 88, the stroke of piston 64, and the resulting displacement in volume in the cylinder chamber. In this embodiment the values for the stroke and volume displacement are for a 0.750 inch diameter piston and a 1.265 inch radius cam having a 0.700 inch throw. A typical 430 cubic inch displacement engine will require 0.660 cubic centimeters of fuel during one engine cycle. This means that the piston must move 0.090 inches to displace that volume. The actuator arm will then hit the cushion at approximately 56 angular degrees of the cam before a maximum actuator position.

Figure 5:
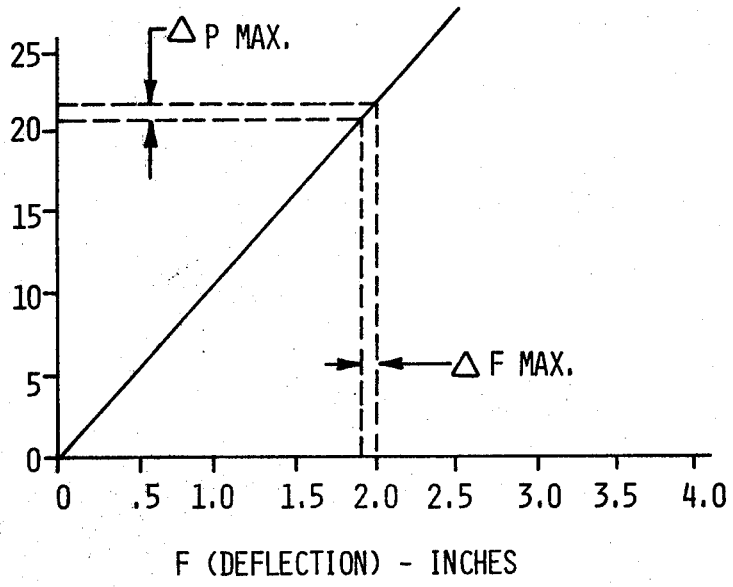
FIG. 5 is a plot of spring load versus deflection for the booster and regulator spring of the present invention.

FIG. 5 is a plot of spring force aginst spring deflection for a spring (used as the first coil spring 72), having a rate of 22 pounds per inch and having a maximum length of two inches. It will be seen that for a 0.090 inch variation in spring length between its two extremes of position the force exerted by the spring will only change by about 2 pounds, or 4%.

It should be noted that this variation in pressure in the rail 14 as a result of the elongation of the first spring 72 is a constant factor and may be weighted into the calculation of the injector pulse width to insure a proper injection volume.

In alternate embodiments of the invention it should be recognized that other forms of variable volume chambers other than a piston moving in a cylinder might be employed. For example, a bellows or a roll diaphragm might be likely forms for the variable volume chamber.

Having thus described my invention, I claim:

1. In a fuel injection system for an internal combustion engine having: at least one fuel injector; a fuel tank; a fuel supply pump; a conduit connecting the fuel tank to said at least one injector; the improvement comprising: an engine driven fuel pressure booster for elevating the pressure at which the fuel is supplied to said at least one injector to a substantially higher pressure than a lower fuel pressure at the output of said system fuel supply pump, said pressure booster comprising: a pair of uni-directional valve means connected in said conduit to prevent fuel flow from said at least one injector toward the tank and isolate the high pressure maintained by the pressure booster from the low pressure maintained by the system fuel supply pump; a variable volume chamber having a cam actuated replenishment stroke and connected to the conduit between the uni-directional valve means; mechanical means including a spring for urging said variable volume chamber into a condition of reduced volume so as to maintain the pressure in the conduit between the uni-directional valve means closer to the tank and said at least one fuel injector at a pressure higher than the vaporization pressure of said fuel, the volume reduction of said chamber produced by said reduced volume condition being small relative to the total volume of said chamber; and means for maintaining instantaneous pressure in said variable volume chamber at a pressure level sufficiently high to prevent vaporization of the fuel during the replenishment stroke.

2. The pressure booster of claim 1 wherein said spring has one end connected to the chamber and the other end fixed relative to the engine.

3. The pressure booster of claim 1 including means for causing the variable volume chamber to move to a condition of expanded volume at periodic intervals.

4. The pressure booster of claim 3 wherein said means for causing the variable volume chamber to move to a condition of expanded volume at periodic intervals is powered by the engine and expands the chamber in timed relation to the speed of the engine.

5. The pressure booster of claim 1 wherein the variable volume chamber comprises a cylinder and a piston movable within the cylinder.

6. The pressure booster of claim 5 wherein said cam actuated means for causing the variable volume chamber to move to a condition of expanded volume includes: a cam driven by the engine, and means, powered by said cam, for moving the piston within the cylinder so as to expand the volume of the chamber in timed relation to the speed of the engine.

7. The pressure booster of claim 6 wherein said means powered by the cam moves the piston within the cylinder to enlarge the chamber once during each cycle of the engine.

8. The pressure booster of claim 6 wherein said means powered by the cam comprises an arm, pivotably supported with respect to the engine, and means for biasing the arm into a position where one end is in abutment to the cam and the other end is positioned relative to said piston so as to periodically retract the piston to enlarge the chamber.

9. The pressure booster of claim 1 wherein said means for maintaining instantaneous pressure in said variable volume chamber comprises: a body having a sealed volume; a flexible diaphragm having a first side which closes off said sealed volume of said body and a second side; and a passage connecting the second side of the diaphragm to the conduit.

10. The pressure booster of claim 9 wherein said passage is connected to the conduit between the fuel pump and the uni-directional valve means closer to the fuel pump in the fluid circuit, and immediately adjacent to said uni-directional valve means.

11. The pressure booster of claim 9 wherein said passage is connected to the conduit between said at least one fuel injector and the uni-directional valve closer to the at least one fuel injector in the fluid circuit, and immediately adjacent to said uni-directional valve means.

12. In a fuel injection system for an internal combustion engine having at least one fuel injector connected to a single conduit, a fuel tank, a relatively low pressure pump for delivering fuel from the tank to the conduit, a uni-directional valve in the conduit to prevent reverse flow to the pump, and means connected to the conduit section which extends from the valve to the injectors for increasing the fuel flow pressure in said section above the pump outlet pressure, the improvement comprising: an engine driven, fuel pressure booster for elevating the pressure at which the fuel is supplied to said at least one injector to a pressure higher than the vaporization pressure of the fuel in said at least one injector, said pressure booster comprising a movable wall forming a boundary of said section; mechanical means including a spring for moving said wall to contract the volume of said section to maintain the pressure at which fuel is supplied to at least said one injector at a pressure higher than the vaporization pressure thereof; cam actuated means for periodically moving said wall to expand the volume of said section, the contraction and expansion volumes produced by said mechanical and cam actuated means being small relative to the total volume of said section; said system further comprising a body having a cavity provided with a flexible diaphragm forming another boundary of said section; said flexible diaphragm supported in the body to seal said cavity, said body connected to the conduit, said diaphragm having two sides, one side of the diaphragm facing the cavity and the other side being exposed to the fuel in the conduit, whereby said diaphragm will assume a position dependent upon the pressure exerted on it by fuel in the conduit, and will act to stabilize the fuel pressure within the conduit.

13. The pressure booster of claim 12 wherein said means for increasing the fuel pressure in the section of the conduit between the valve and the injectors includes a variable volume chamber and said body is connected to the conduit in immediate proximity to said means for increasing the fluid pressure.

14. The pressure booster of claim 12 wherein said body is connected to the conduit adjacent to the injectors.

15. The pressure booster of claim 14 further including a second body having a cavity and a flexible diaphragm supported in the body so as to seal the cavity, said second body being connected to the conduit adjacent to the injectors.

16. A method for elevating a pressure at which fuel is supplied to at least one injector of a fuel injection system in an engine to a pressure higher than the vaporization pressure of the fuel in said at least one injector, comprising:

supplying fuel at a lower pressure than the elevated pressure from a system fuel supply pump to a pressure booster;

maintaining instantaneous pressure in said pressure booster at a pressure above the fuel vaporization pressure during a cam actuated replenishment stroke in said pressure booster;

isolating said at least one injector from a variable volume chamber in the pressure booster during said replenishment stroke of the pressure booster, the variation in chamber volume produced by said replenishment stroke being small relative to the volume of said chamber;

isolating said variable volume chamber of the pressure booster from said fuel supply pump during a pressure boosting stroke in said pressure booster, the variation in chamber volume produced by said pressure boosting stroke being small relative to the volume of said chamber;

maintaining substantially constant instantaneous pressure at the outlet of said pressure booster during the replenishment stroke;

expanding said variable volume chamber of the pressure booster periodically upon actuation of said cam as a function of engine operation and applying pressure on said fuel in a conduit between said pressure booster and said at least one injector by mechanical means including a spring periodically and as a function of engine operation, said pressure applied to said fuel being greater than the vaporization pressure thereof.

17. The method according to claim 16 wherein the step of expanding the variable volume chamber is accomplished simultaneously with the step of compressing the spring in the pressure booster.

18. The method according to claim 16 wherein the step of compressing the spring is accomplished by use of power from the engine.

19. The method according to claim 16 wherein the step of expanding the variable volume chamber is accomplished by use of power from the engine.

20. A method for elevating a pressure at which fuel is supplied to at least one injector of a fuel injection system in an internal combustion engine to a pressure higher than the vaporization pressure of the fuel in said at least one injector, comprising:

supplying fuel at a lower pressure than the elevated pressure from a system fuel supply pump to a pressure booster;

maintaining instantaneous pressure in said pressure booster at a pressure above the fuel vaporization pressure during a cam actuated replenishment stroke in said pressure booster;

isolating said at least one injector from a variable volume chamber in the pressure booster during said replenishment stroke of the pressure booster, the variation in chamber volume produced by said replenishment stroke being small relative to the volume of said chamber;

isolating said variable volume chamber of the pressure booster from said fuel supply pump during a pressure boosting stroke in said pressure booster, the variation in chamber volume produced by said pressure boosting stroke being small relative to the volume of said chamber;

maintaining substantially constant instantaneous pressure at the outlet of said pressure booster during the replenishment stroke;

expanding said variable volume chamber of the pressure booster periodically upon actuation of said cam and as a function of engine operation;

compressing a spring in the pressure booster having predetermined strength characteristics periodically and as a function of engine operation by use of power from the engine simultaneous with said step of expanding said variable volume chamber; and applying pressure on said fuel in a conduit between said pressure booster and regulator and said at least one injector periodically and as a function of engine operation by application of force from said spring, said pressure applied to said fuel being greater than the vaporization pressure thereof.

* * * * *